US009903580B2

(12) United States Patent
Sachsenweger et al.

(10) Patent No.: US 9,903,580 B2
(45) Date of Patent: Feb. 27, 2018

(54) LED MODULE WITH A HEAT SINK

(71) Applicant: Osram GmbH, Munich (DE)

(72) Inventors: Peter Sachsenweger, Zeitlarn (DE); Guenter Hoetzl, Regensburg (DE); Robert Kraus, Regensburg (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/349,091

(22) PCT Filed: Oct. 2, 2012

(86) PCT No.: PCT/EP2012/069481
§ 371 (c)(1),
(2) Date: Apr. 2, 2014

(87) PCT Pub. No.: WO2013/053626
PCT Pub. Date: Apr. 18, 2013

(65) Prior Publication Data

US 2014/0247611 A1 Sep. 4, 2014

(30) Foreign Application Priority Data

Oct. 12, 2011 (DE) ..... 10 2011 084 365

(51) Int. Cl.
*F21V 17/08* (2006.01)
*F21V 29/00* (2015.01)
(Continued)

(52) U.S. Cl.
CPC ..... *F21V 29/71* (2015.01); *F21V 17/08* (2013.01); *F21V 19/004* (2013.01);
(Continued)

(58) Field of Classification Search
CPC .... F21V 19/00; F21V 19/004; F21V 19/0055; F21V 19/005; F21Y 101/02
See application file for complete search history.

(56) References Cited

U.S. PATENT DOCUMENTS 8,933,616 B2 * 1/2015 Keser ..... F21V 19/001 313/46
9,039,257 B2 * 5/2015 Noro et al. ..... 362/382
(Continued)

FOREIGN PATENT DOCUMENTS

CN 102022640 A 4/2011
DE 202006017583 U1 4/2008
(Continued)

OTHER PUBLICATIONS

International Search Report issued in the corresponding PCT application No. PCT/EP2012/069481, dated Feb. 28, 2013.
(Continued)

*Primary Examiner* — Andrew Coughlin
*Assistant Examiner* — Eric T Eide
(74) *Attorney, Agent, or Firm* — Viering, Jentschura & Partner mbB

(57) ABSTRACT

An illuminating device includes: at least one lighting module, and at least one lighting module support, wherein the lighting module support is provided in order to dissipate heat from the lighting module and at least one first fastening element for fastening the lighting module on the lighting module support is provided, wherein the first fastening element is designed in such a way that the lighting module is pressed with a defined pressing force onto the lighting module support in such a way that a defined transfer of heat between the lighting module and lighting module support is enabled, and, in the region of the first fastening element, a movement of the lighting module, in particular a thermal expansion, parallel to the main plane of the lighting module is enabled.

8 Claims, 10 Drawing Sheets

(51) Int. Cl.
*F21V 29/71* (2015.01)
*F21V 19/00* (2006.01)
*F21Y 115/10* (2016.01)

(52) U.S. Cl.
CPC ..... *F21V 19/005* (2013.01); *F21V 19/0055* (2013.01); *F21Y 2115/10* (2016.08)

(56) References Cited

U.S. PATENT DOCUMENTS

| | | | | |
|---|---|---|---|---|
| 9,046,258 | B2 * | 6/2015 | Singer et al. | 362/218 |
| 2006/0141851 | A1 | 6/2006 | Matsui et al. | |
| 2007/0041220 | A1 * | 2/2007 | Lynch | 362/646 |
| 2007/0268707 | A1 | 11/2007 | Smester | |
| 2008/0043473 | A1 * | 2/2008 | Matsui | F21V 19/0055 362/294 |
| 2008/0130275 | A1 | 6/2008 | Higley et al. | |
| 2008/0135865 | A1 | 6/2008 | Stoyan et al. | |
| 2008/0224166 | A1 | 9/2008 | Glovatsky et al. | |
| 2009/0244909 | A1 | 10/2009 | Chen | |
| 2011/0063842 | A1 | 3/2011 | Takei et al. | |
| 2011/0063865 | A1 | 3/2011 | Komatsu et al. | |
| 2011/0069502 | A1 | 3/2011 | Hum | |
| 2011/0074271 | A1 * | 3/2011 | Takeshi et al. | 313/46 |
| 2013/0077324 | A1 * | 3/2013 | Schroll | F21V 19/002 362/382 |

FOREIGN PATENT DOCUMENTS

| | | | |
|---|---|---|---|
| DE | 102008000582 | A1 | 9/2008 |
| DE | 102009001405 | A1 | 10/2009 |
| EP | 2333398 | A2 | 6/2011 |
| TW | 200624710 | A | 7/2006 |
| WO | 2004071143 | A1 | 8/2004 |
| WO | 2006049086 | A1 | 5/2006 |
| WO | 2009121439 | A1 | 10/2009 |

OTHER PUBLICATIONS

Office Action issued in the corresponding German application No. 102011084365.5, dated May 30, 2012.

Chinese Office Action based on Application No. 201280050502A(9 Pages and 7 pages of English translation) dated Apr. 5, 2016 (Reference Purpose Only).

* cited by examiner

LED MODULE WITH A HEAT SINK

RELATED APPLICATIONS

The present application is a national stage entry according to 35 U.S.C. § 371 of PCT application No.: PCT/EP2012/069481 filed on Oct. 2, 2012, which claims priority from German application No.: 10 2011 084 365.5 filed on Oct. 12, 2011, and is incorporated herein by reference in its entirety.

TECHNICAL FIELD

Various embodiments relate to an illuminating device including at least one lighting module and at least one lighting module support, wherein the lighting module support is provided in order to dissipate heat from the lighting module.

BACKGROUND

Illuminating devices, in particular those in which semiconductor light sources, such as LEDs, are used for light generation, are often formed in a modular manner, that is to say different modules having different functions are provided. Here, what are known as the lighting modules, that is to say the modules that basically carry the actual light sources, are of central importance. These modules are to be easily mountable, but at the same time are to be held reliably and are to have a good transfer of heat to the lighting module support arranged therebelow in order to be able to reliably dissipate the heat produced during operation of the light sources. For this purpose, the lighting modules are usually screwed or adhesively bonded to the lighting module carrier, such that the mechanical contact is ensured. A disadvantage however of an adhesive bond is that the module can only be removed with difficulty from the support or may no longer be removable at all from the support. By contrast, in the case of a screw or rivet connection, the lighting module can indeed be separated again easily from the support, however it is fixed by the screws at the screw holes such that, with heating, the lighting module may bulge due to the different thermal expansion of modules and support, and therefore the thermal connection to the support is impaired or interrupted and the module may overheat. The module may also sustain mechanical damage due to the bulging. In order to improve the thermal contact between lighting module and module support, what is known as a thermal interface material (TIM) is often introduced between the lighting module and lighting module support and improves the thermal contact in particular by compensating for unevennesses. This is complex however and also may not ensure the thermal contact in the event of excessive bulging of the module.

SUMMARY

Various embodiments provide a fastening of a lighting module to a lighting module support, said fastening being secure and reliable, but detachable by simple means, wherein the cooling of the lighting module is to be ensured in all operating situations.

Good heat dissipation is achieved in that at least one first fastening element for fastening the lighting module on the lighting module support is provided, wherein the first fastening element is designed in such a way that the lighting module is pressed with a defined pressing force onto the lighting module support in such a way that a defined transfer of heat between the lighting module and lighting module support is enabled. Since, in the region of the first fastening element, a movement of the lighting module, in particular a thermal expansion, parallel to the main plane of the lighting module is enabled, the lighting module support is prevented from deforming or rupturing with increasing heating. A good transfer of heat is provided in particular if the contact resistance at the transfer area from the lighting module to the lighting module support is no more than 20,000 $m^2K/W$, preferably no more than 5,000 $m^2K/W$. Since the pressing force is selected such that a pressure between 0.002 $N/mm^2$ and 1.0 $N/mm^2$, preferably between 0.05 $N/mm^2$ and 0.5 $N/mm^2$, particularly preferably between 0.08 $N/mm^2$ and 0.3 $N/mm^2$, in particular from approximately 0.1 $N/mm^2$ to 0.2 $N/mm^2$, is exerted onto the heat transfer areas, both a good transfer of heat and a good detachability of the connection in the event of an exchange of the light source are enabled in the usual conditions of a system of this type. In particular, printed circuit boards or substrates with light sources arranged thereon are to be considered as lighting modules, wherein components such as connecting devices, such as plugs or soldering lugs, electronic circuits or individual component parts may also be provided.

Since at least one second fastening element is provided, which fixes the lighting module support at least at one point in the region of the second fastening element, it is ensured on the one hand that the lighting module is securely positioned, which for example may be important in relation to optical means, such as reflectors or lenses, for an accurate beam guidance of the emitted light, and on the other hand that there is no inadmissible mechanical loading due to the movability in the first fastening element. A certain divisioning of the tasks between the fastening elements is thus achieved, that is to say the at least one first fastening element serves to apply a defined pressing force in order to enable a good transfer of heat to the lighting module support, whereas the at least one second fastening element serves for mechanical positioning.

Since the second fastening element includes at least one screw and/or at least one rivet, the lighting module is fixed in its position in a particularly simple manner, for example in that a screw hole having the diameter of the screw is provided in a circuit board of the lighting module and in that a threaded hole for receiving the screw is provided in the lighting module support.

It may likewise be advantageous if the lighting module is fixed in a defined region by means of an adhesive bond. This region expediently accounts for only a small part, in particular less than 20%, of the area in contact with the lighting module support, for example in the case of a rectangular module a region adjacent to the narrow side.

It is generally advantageous if the second fastening element and the first fastening element are distanced from one another by more than 50% of the length of the lighting module, measured in the direction between the fastening regions, since the effect of the thermal expansion of the lighting module is particularly pronounced with a long distance between the fastening regions.

The first fastening element expediently includes at least one spring element. Spring elements are particularly suitable for applying a defined force, and, in so doing, can nevertheless compensate for dimensional tolerances. As a result, a sufficiently fixed contact for an optimized transfer of heat is enabled, and excessive pressing is also avoided and the desired movability of the lighting module is ensured. The connection can also be detached again easily.

Since the first fastening element includes at least one punched part, and in particular is formed as a punched part, simple manufacture is possible.

The manufacture is particularly simple if the punched part is formed as a punched spring steel sheet.

It is advantageous if the spring element includes at least one first fastening region for fastening on the lighting module support and at least one spring arm for applying the pressing force to the lighting module. This is a particularly simple structure, which for example can be easily manufactured using punched parts.

Since the spring element includes at least one second fastening region for fastening on the lighting module support, a particularly good fastening can be achieved.

Since the second fastening region is formed as the second fastening element or includes the second fastening element, a fixing of the lighting module at one point and a displaceable fastening at another point can be achieved using a single component. This reduces the complexity of the assembly process.

The first fastening region and the second fastening region are advantageously connected by means of at least one bridge. Simple fabrication and assembly are thus possible.

Since the bridge includes at least one spring element and/or is formed as at least one spring element, a particularly simple structure is achieved, in which the number of required parts can be minimized.

In an advantageous embodiment the bridge, between the two fastening regions, includes at least one contact point for introducing force onto the lighting module. The force can thus be introduced particularly advantageously at the regions of the lighting module where required.

It is furthermore advantageous if the first fastening element includes at least one fixing means for delimiting the movement of the lighting module. A movement within defined limits is thus possible, such that a sufficiently accurate positioning of the lighting module in relation to an optical means, such as a reflector, can be implemented for example, and yet a sufficient expansion of the lighting module is possible in order to avoid undesirable deformation or detachment of the module from the support.

Since the fastening means has a substantially U-shaped geometry, a particularly simple manufacturing process is possible. In particular, the bend of the U may serve here as a fastening region for the fastening of the fastening means on the lighting means support, whereas the two branches of the U as a pressing element, for example in the form of a spring element, press the lighting module onto the lighting module support.

In a further advantageous embodiment the fastening means has a substantially frame-shaped geometry. This is a simple structure, which in particular can be used advantageously with fastening means having two fastening regions, since these are arranged for example on opposite sides of the frame, whereas these sides are connected by means of two bridges, between which the light sources of the lighting module are arranged.

Semiconductor light sources, in particular light-emitting diodes (LEDs) or organic light-emitting diodes (OLEDs), are preferably used as light sources. These provide a high light output and benefit in particular from good cooling, since the service life and color fidelity thereof increase.

It is likewise advantageous if the lighting module carrier is formed as a heat sink, since a simple structure is thus achieved and the cooling of the light sources is optimized.

It may also be advantageous if the lighting module support is formed as a housing part of a luminaire. A particularly simple structure is thus achieved, and the luminaire housing can be used for cooling.

Although is usually possible to dispense with a TIM between the lighting module and lighting module support, in some applications such a material between the lighting module and lighting module support may also be advantageous in order to further improve the thermal transfer.

A series of first fastening means is advantageously provided, wherein different fastening means within the series have a substantially identical first fastening region. The lighting module carrier can thus be formed identically in each case with use of different fastening means, as is necessary for example with use of different lighting modules, and the adaptation is implemented by the selection of the suitable fastening means.

It is expedient in particular if, with the series of fastening means, different fastening means within the series have substantially the same geometry and differ by the strength of the pressing force that can be exerted onto the lighting module. With an otherwise unchanged geometry of lighting module and lighting module support, the pressing force can thus be adapted to the intended use, that is to say in the case of lighting modules with low heat development a lower pressing force can be selected than with lighting modules with high heat development.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1A:
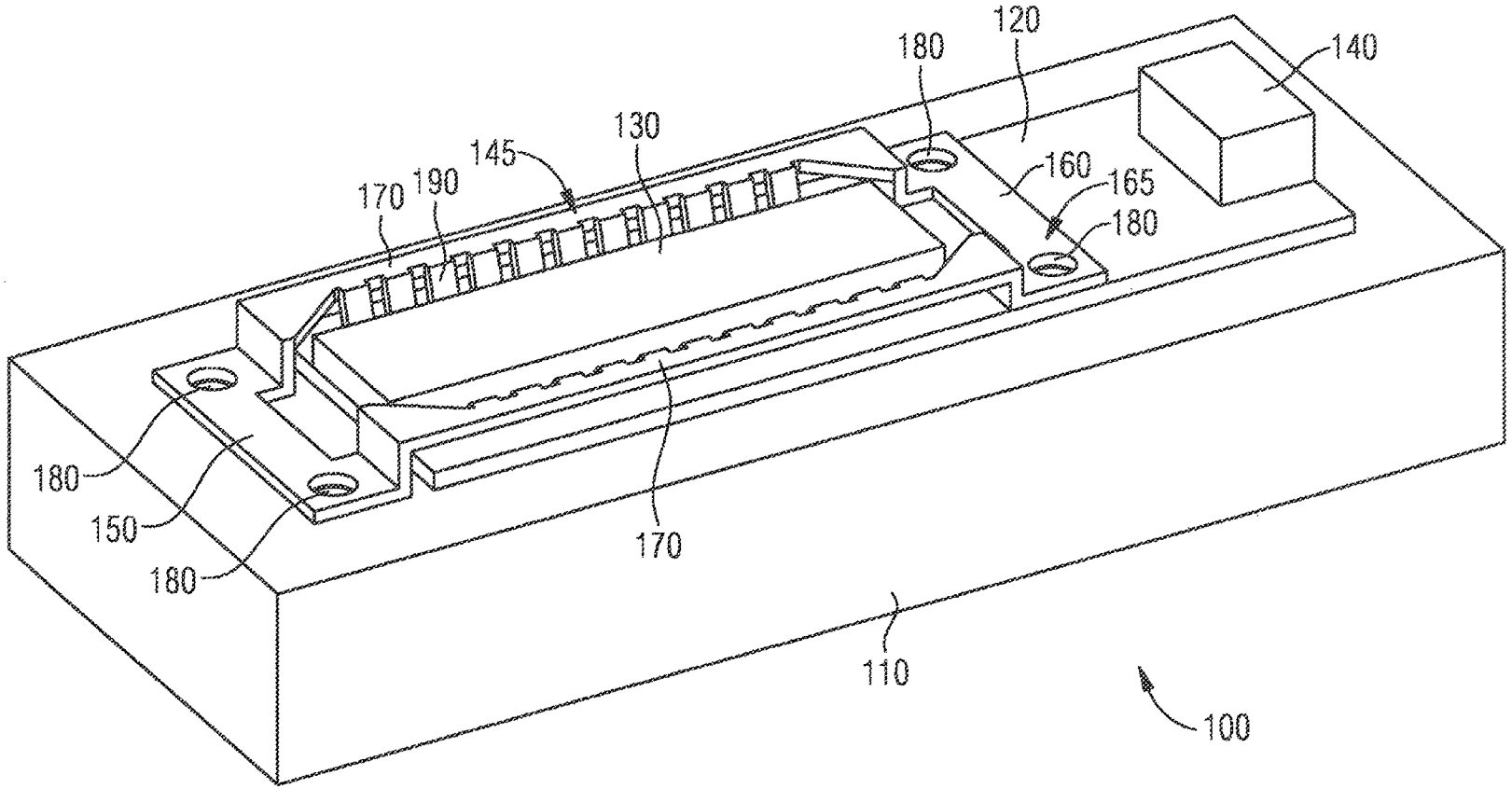
FIGS. 1A to 1C show a first embodiment of the disclosure in a perspective overall view, in a perspective detailed view, and in a cross section.
Figure 1B:
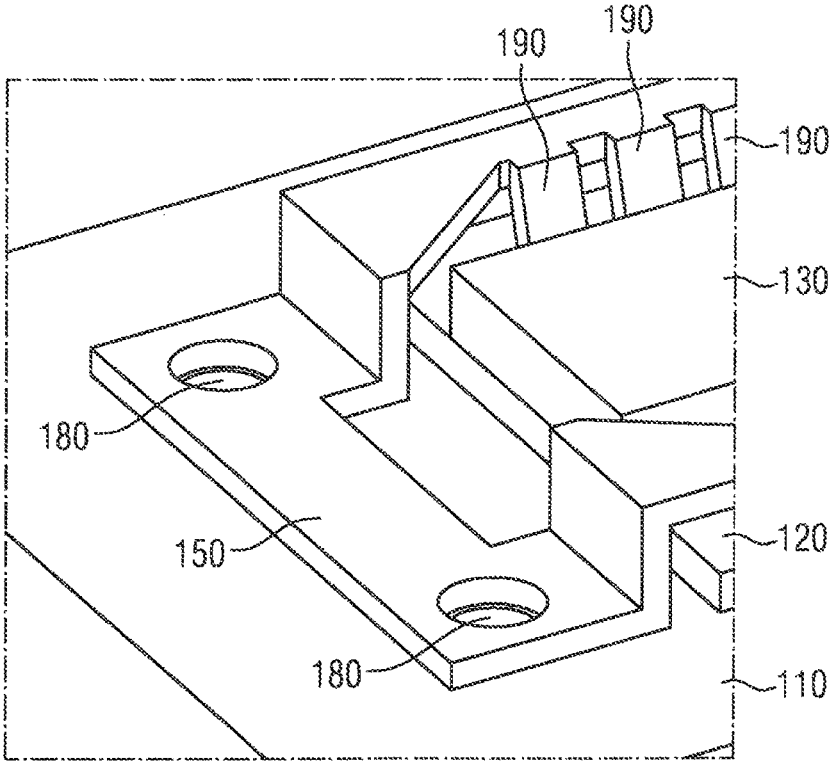
Figure 1C:
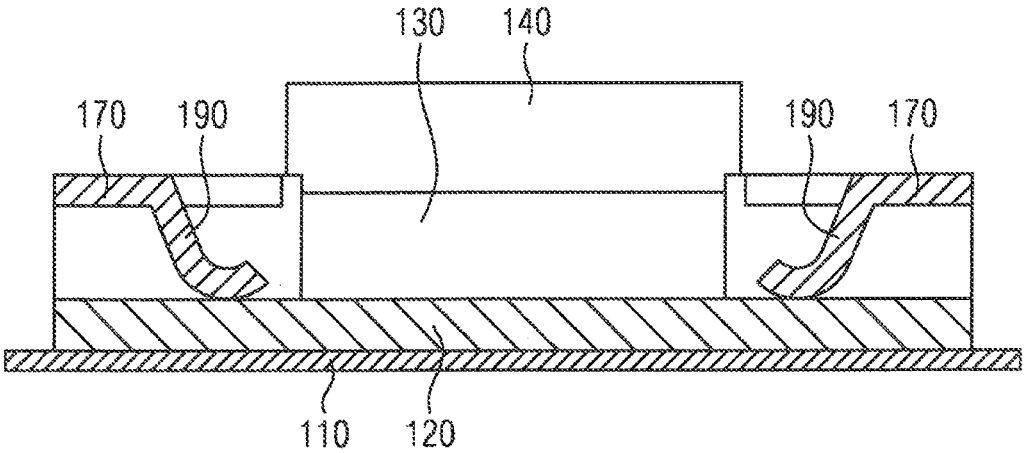

FIGS. 1A to 1C show a first embodiment of an illuminating device 100 according to the disclosure in a perspective overall view, in a perspective detailed view, and in a cross section. A rectangular lighting module 110 is arranged on a lighting module support 120, wherein the lighting module 110 includes LEDS 130 as light sources and a connecting plug 140 for electrical contact. The lighting module support 120 is fastened by means of a frame-shaped first fastening element 145 on the lighting module support 110, which includes two fastening regions 150, 160, which are connected by means of two bridges 170. The first fastening region 150 constitutes a first frame side of the fastening element 145 and includes two screw holes 180, by means of which it can be screwed on the lighting module support 110 by means of screws (not illustrated here for the sake of clarity). The second fastening region 160 also includes two screw holes 180, through which the fastening element 145 is connected to the light module support 120 by means of two screws (not illustrated here) and therefore also fixes the lighting module 110 at this point. The screws and the second fastening region 160 thus form a second fastening element 165, which is formed as part of the first fastening element 145. Spring arms 190 are arranged on the bridges 170 and act on the lighting module 110 and press it with a defined pressing force onto the lighting module support 120. The fastening element 145 is punched out from a spring steel sheet, which allows particularly simple manufacture. Due to the plurality of spring arms 190, the pressing force is introduced in a distributed manner, which ensures a uniform bearing force and therefore a uniform transfer of heat. The spring arms 190 are rounded in the region in which they bear on the lighting module 120, which facilitates the assembly of the illuminating device 100 and additionally facilitates a movement of the lighting module 120. During operation of the lighting module, it is heated in the region of the light-emitting diodes 130 and expands. Since it is fixed at the second fastening region 160, the expansion occurs preferably in the direction of the first fastening region 150. Since the spring arms 190 do not significantly hinder the thermal expansion of the lighting module 110, the spring arms still bear on the lighting module support 110 with the desired force.

Figure 2A:
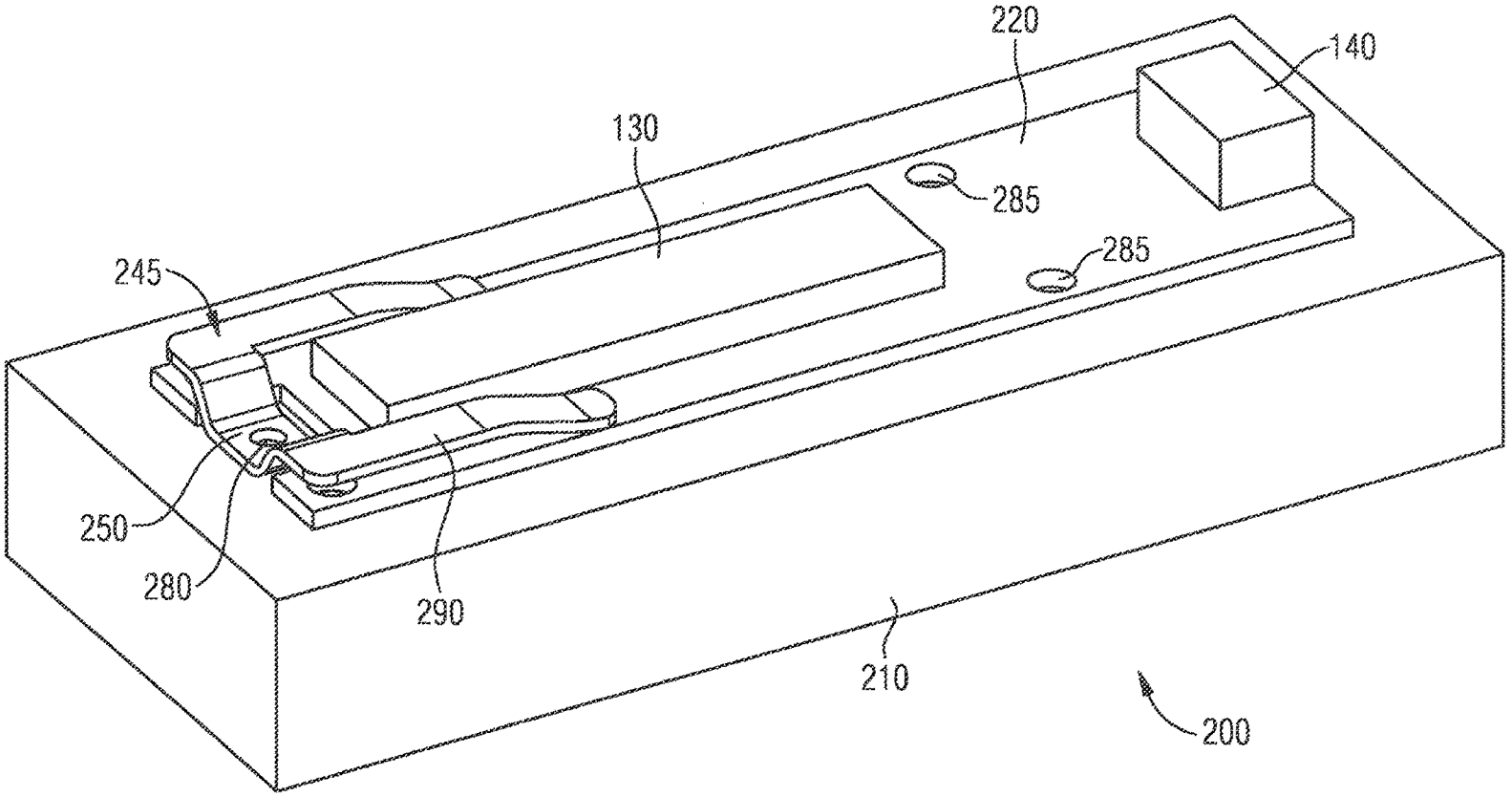
FIGS. 2A to 2C show a second embodiment of the disclosure in a perspective overall view, in a perspective detailed view, and in a side view.
Figure 2B:
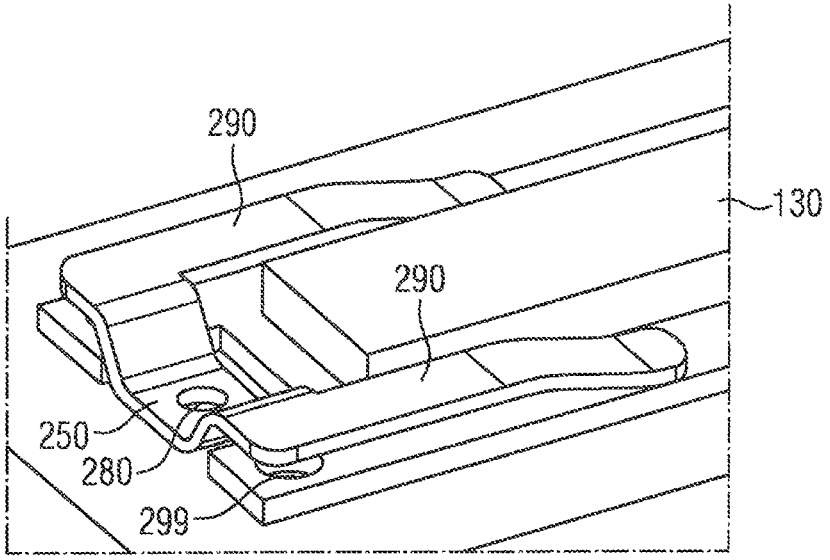
Figure 2C:
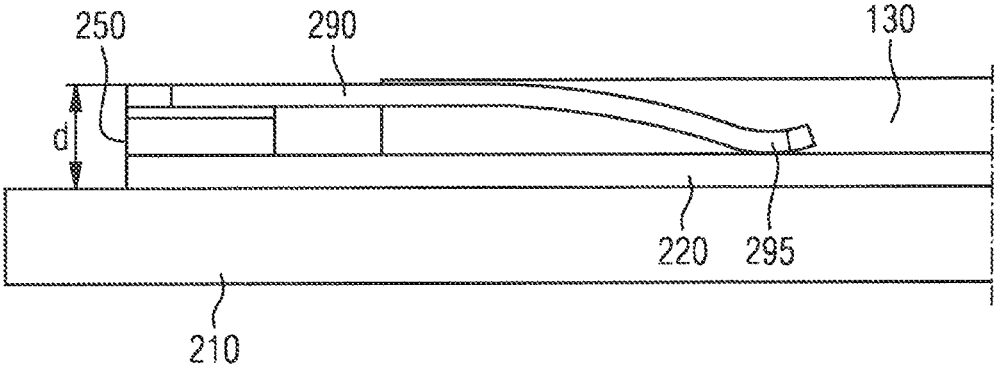

A further embodiment of an illuminating device 200 according to the disclosure is shown in FIGS. 2A to 2C. The lighting module 220 is held on the lighting module support 210 by means of a first fastening element 245, likewise punched from spring steel sheet. Here, screws (not illustrated) in the screw holes 285, which fix the lighting module 220 at this point, serve as a second fastening element. The first fastening element 245 is U-shaped and, in the curve of the U, has a first fastening region 250, in which a screw hole 280 for receiving a screw (not illustrated here) is provided in order to fix the fastening element 245 on the lighting module support 210. The branches of the U are formed as spring arms 290, which press the lighting module 220 with a predefined force onto the lighting module support in order to ensure the desired transfer of heat. Here too, as the lighting module 220 is heated, it is fixed at the screw holes 285, whereas an expansion in the direction of the first fastening region 250 is possible. In order to minimize the friction here, the spring arms are rounded at their contact point 295. The lighting module 220 here also has fastening holes 299, which can be used alternatively for a screwing of the module according the related art, that is to say the presented solution is also suitable (as are also the other exemplary embodiments) for retrofitting for existing illuminating devices.

Figure 3A:
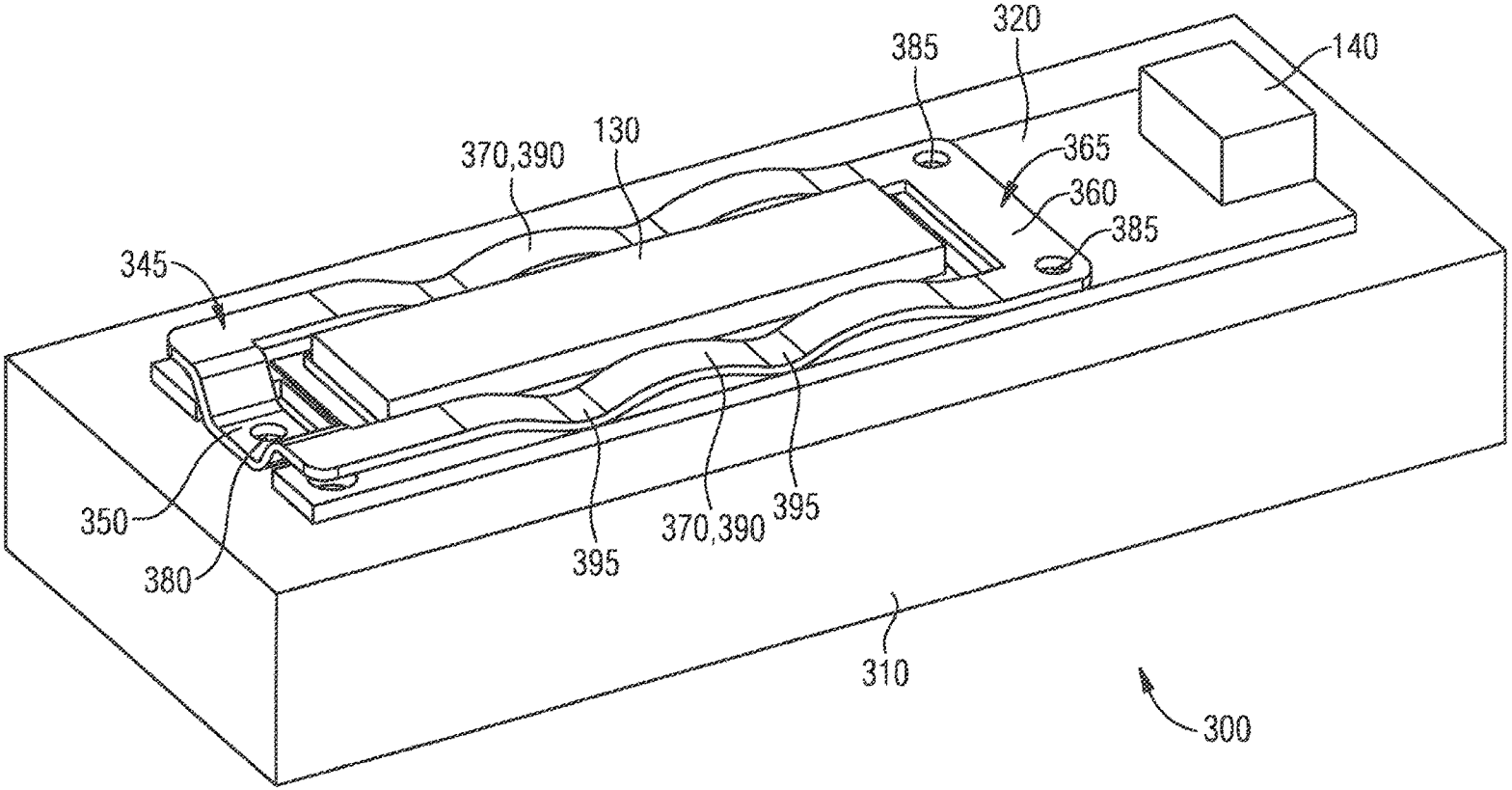
FIGS. 3A to 3C show a third embodiment of the disclosure in a perspective overall view, in a perspective detailed view, and in a side view.
Figure 3B:
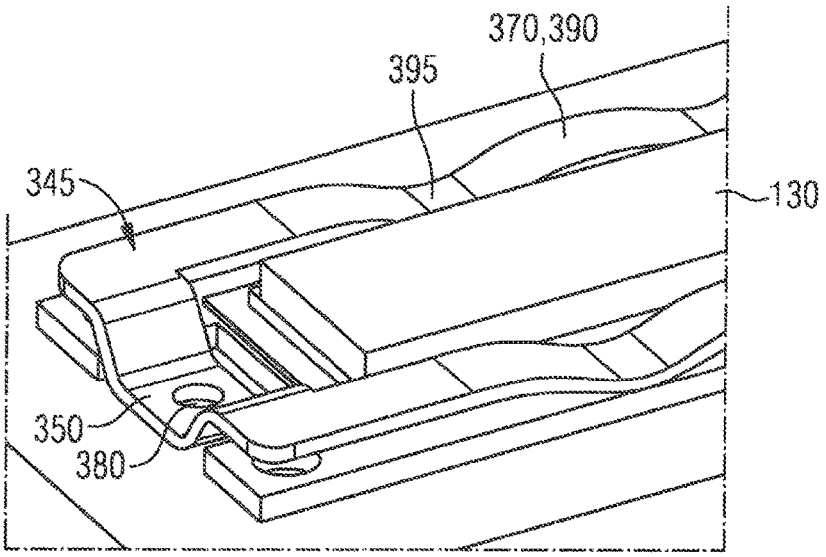
Figure 3C:
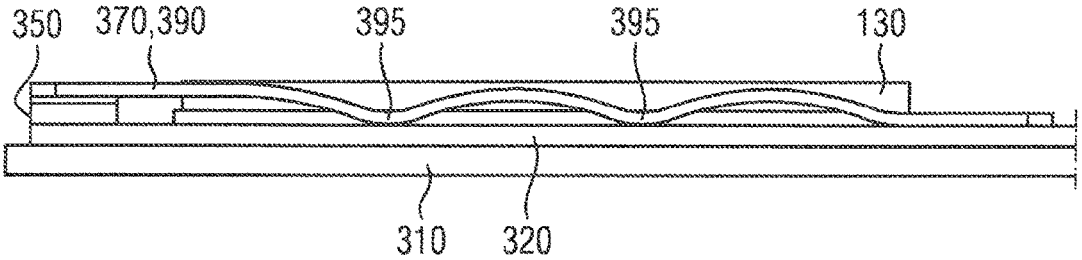

FIGS. 3A to 3C show a further embodiment for an illuminating device 300 having a lighting module 320 on a lighting module support 310, wherein the first fastening element 345 is formed here in a frame-shaped manner similarly to the first embodiment. The first fastening region 350, similarly to the second embodiment, has only one central screw hole 380 however. The second fastening region 360 is formed similarly to the first embodiment with screw holes 385, in which the lighting module 320 is fixed by means of screws (not illustrated here) and thus forms a second fastening element 365. In contrast to the preceding embodiments, the bridges 370 here are formed themselves as spring arms 390 and have two bearing points 395 per side. An advantage of this design compared with the first embodiment is the simpler production since fewer spring arms are required and these are part of the bridges 370, and the advantage compared with the second embodiment is that force is introduced in a manner better distributed, and, due to the frame design, this can also be implemented more reliably than with a U-shaped design.

Figure 4A:
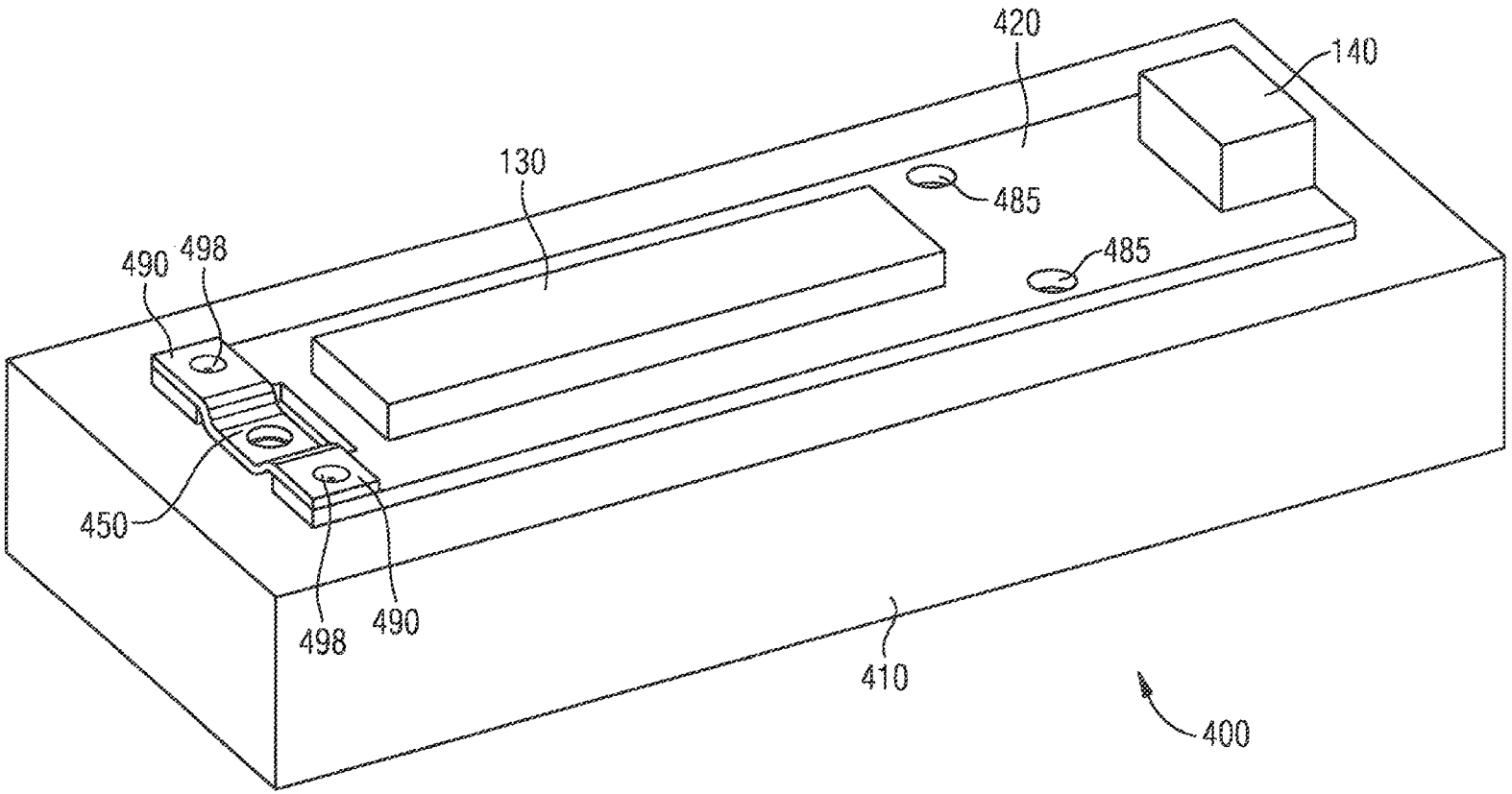
FIGS. 4A to 4C show a fourth embodiment of the disclosure in a perspective overall view, in a perspective detailed view, and in a side view.
Figure 4B:
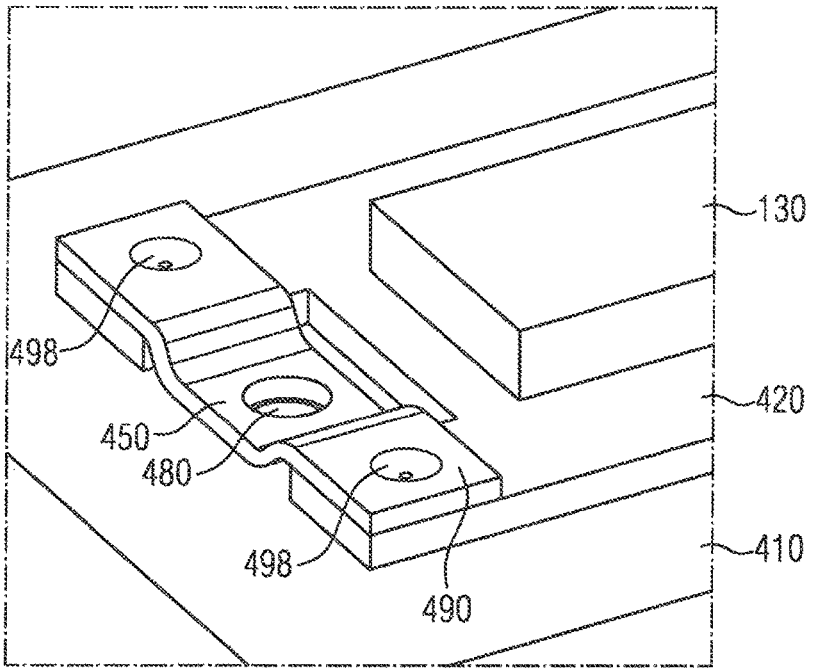
Figure 4C:
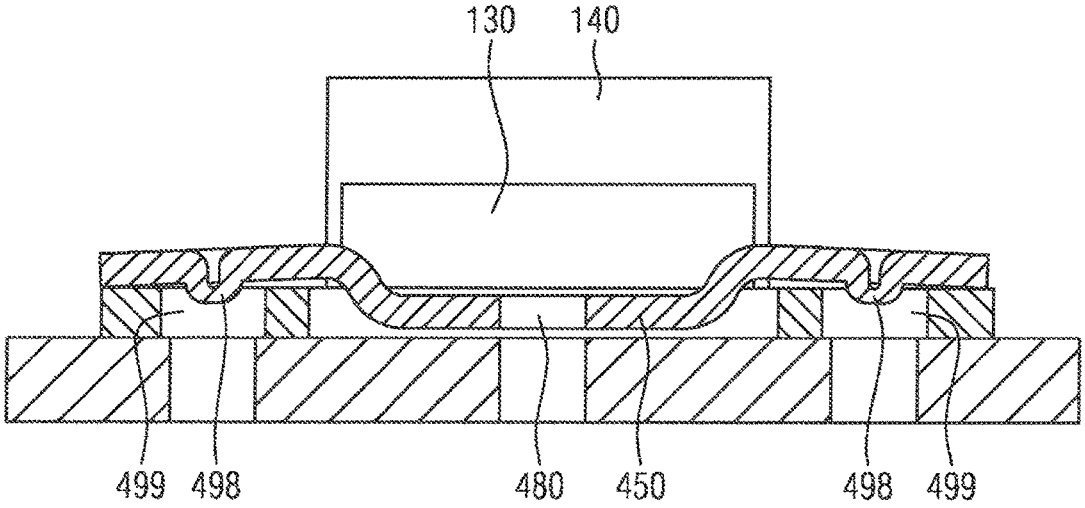

FIGS. 4A to 4C show a further particularly simple embodiment of an illuminating device 400, in which the lighting module 420, similarly to the first and third embodiment, is fixed on one side on the lighting module support 410 by means of screws (not illustrated here) in screw holes 485 and is held on the other side by means of a strip-like fastening element 445. The fastening element 445 includes a first fastening region 450 with a screw hole 480, from which spring arms 490 extend on either side. The spring arms 490 lie in the edge region of the lighting module 420 and thus press said module in a defined manner onto the lighting module support 410. In order to additionally provide a mechanical fixing, retaining domes 498 are impressed into the spring arms 490 and restrict an excessive displacement of the lighting module 420 by engagement with the screw holes 499. These screw holes 499, similarly to the module in the second embodiment, may already be provided in modules according to the related art, however it also possible that modules will be provided purposefully with holes of this type for this purpose.

Figure 5A:
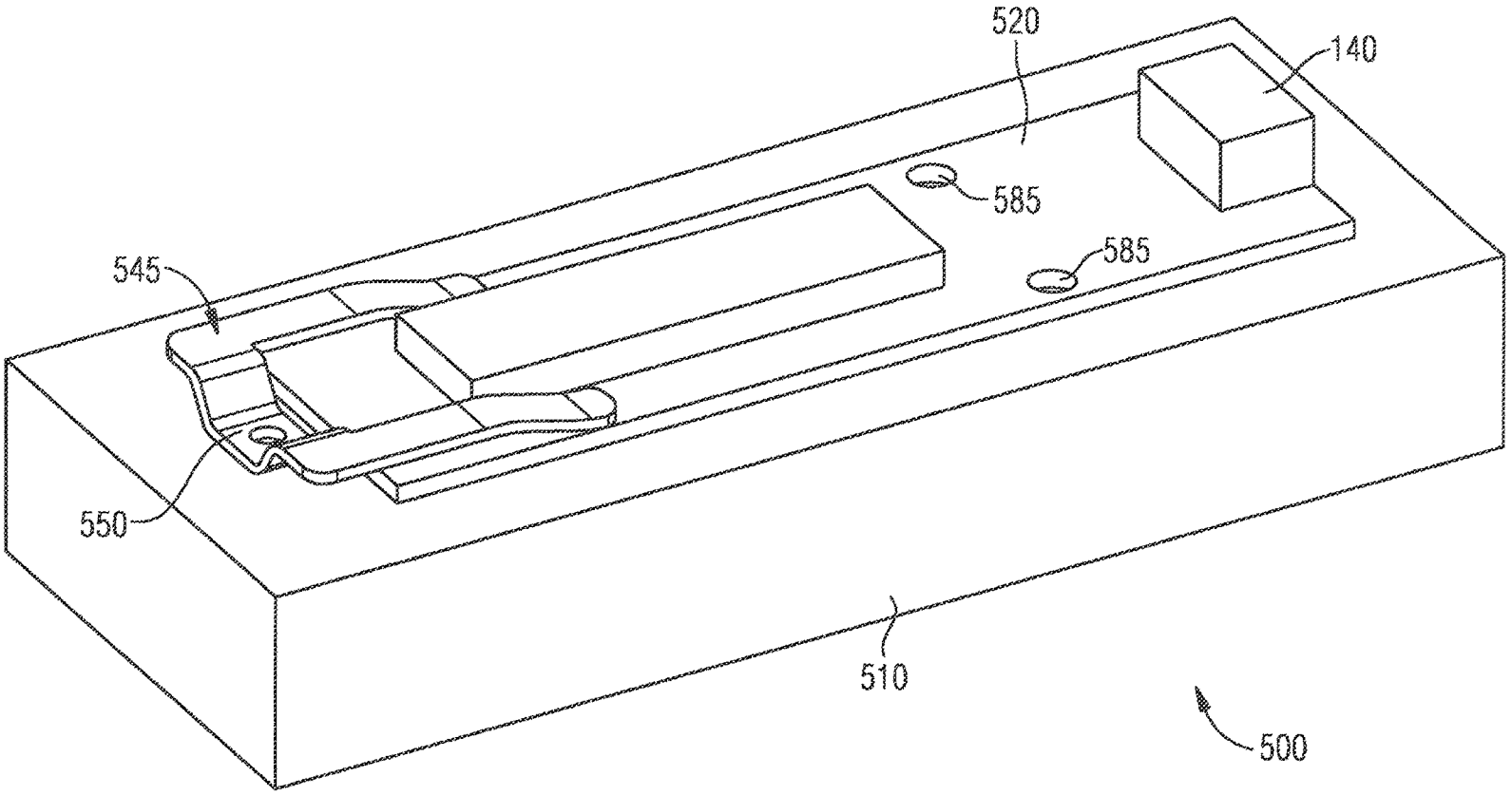
FIGS. 5A to 5C show a fifth embodiment of the disclosure in a perspective overall view, in a perspective detailed view, and in a side view.
Figure 5B:
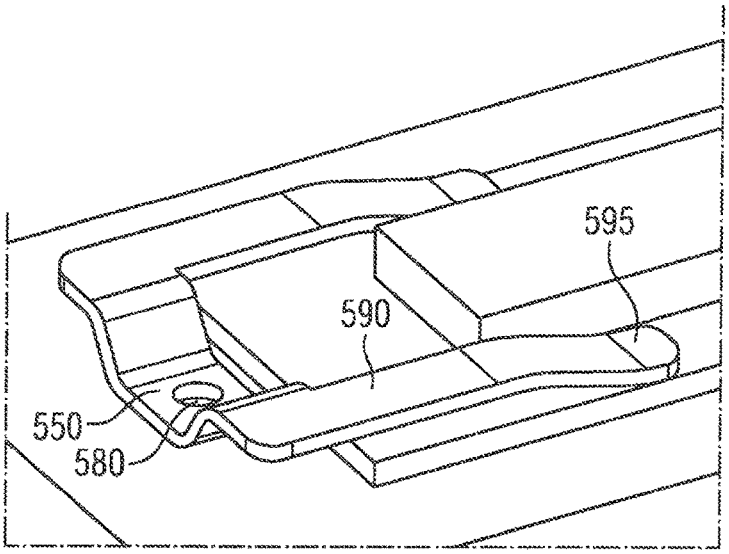
Figure 5C:
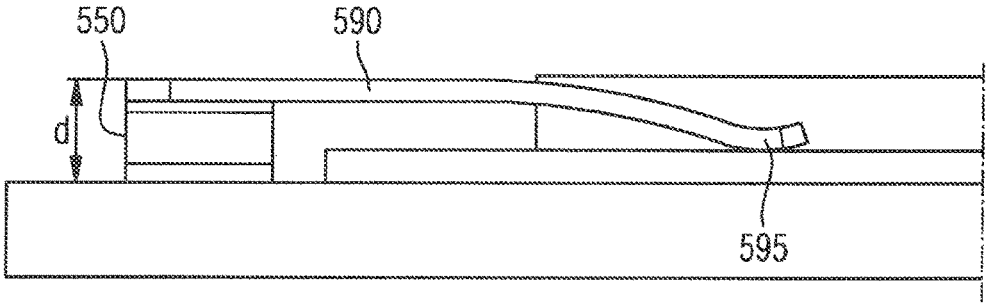

FIGS. 5A to 5C show a variant of the second embodiment, which basically only differs by the embodiment of the lighting module 520, since this now includes no screw holes 299 and is thus more compact. The fixing by means of the screw holes 585 is implemented similarly to that in the second embodiment via the holes 285, and the pressing by means of the fastening element 545 is likewise implemented similarly to that with the fastening element 245, specifically by spring tongues 590, wherein the fastening element 545 is held at a first fastening region 550 by means of a screw in the screw hole 580. The rounding of the spring arms 590 at the bearing points 595 is also formed identically. The two fastening elements 545 and 245 can be considered as representatives of a series of fastening elements which have the same geometric basic shape, but have different heights d for adaptation to different geometries of lighting modules 220, 520, such that the same spring force can be applied to lighting modules 220, 520 of different height, or lighting modules 220, 520 of identical height can be acted on by different spring force.

In particular, the fastening elements 245, 445 and 545, which are held by only one screw, may additionally also includes elements that prevent a rotation as the screw is tightened, for example retaining lugs, which engage in a recess in the lighting module support 210, 410, 510.

If the pressing pressure of the spring arms 190, 290 in the case of the shown fastening elements 145, 245 is to be changed, spring arms having different spring constants can be used for example within the scope of a series of fastening elements, or a pre-bending of the spring arms 190, 290 can be varied, such that the suitable fastening element can be selected depending on the intended use.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An illuminating device-comprising:

at least one lighting module, at least one lighting module support, wherein the lighting module support is provided in order to dissipate heat from the lighting module, and at least one first fastening region comprising at least one first fastening element for fastening the lighting module on the lighting module support; wherein the at least one first fastening element comprises a u-shaped geometry having two branches extending from a bend therebetween; wherein each branch consists of a spring arm and contacts the bend;

at least one second fastening region for fastening at least one second fastening element on the lighting module and/or the lighting module support; and at least one bridge connecting each spring arm of the at least one fastening element to the at least one second fastening element; wherein the at least one bridge comprises a wave-like shape between the at least one first fastening element and the at least one second fastening element.

2. The illuminating device as claimed in claim 1, wherein the second fastening element comprises at least one screw and/or at least one rivet.

3. The illuminating device as claimed in claim 1, wherein the first fastening element comprises at least one punched part.

4. The illuminating device as claimed in claim 3, wherein the punched part is formed as a punched spring steel sheet.

5. The illuminating device as claimed in claim 1, wherein the at least one bridge comprises, between the at least one first fastening region and the at least one second fastening region, at least one contact point for introducing force onto the lighting module and/or the lighting module support.

6. The illuminating device as claimed in claim 1, wherein the at least one first fastening element comprises at least one fixing means for delimiting the movement of the lighting module.

7. The illuminating device as claimed in claim 1, wherein the at least one first fastening element has a substantially frame-shaped geometry.

8. The illuminating device as claimed in claim 1, wherein the movement of the lighting module is a thermal expansion.

* * * * *